US011041624B2

(12) United States Patent
Witham et al.

(10) Patent No.: US 11,041,624 B2
(45) Date of Patent: Jun. 22, 2021

(54) FUEL SPRAY NOZZLE FOR A GAS TURBINE ENGINE

(71) Applicant: ROLLS-ROYCE plc, London (GB)

(72) Inventors: Frederic Witham, Bristol (GB); Steven P Jones, Bristol (GB); Jonathan M Gregory, Cheltenham (GB); Timothy Minchin, Bristol (GB); David Clarke, Bristol (GB); David Steele, Cheltenham (GB)

(73) Assignee: ROLLS-ROYCE PLC, London (GB)

( * ) Notice: Subject to any disclaimer, the term of this patent is extended or adjusted under 35 U.S.C. 154(b) by 664 days.

(21) Appl. No.: 15/185,596

(22) Filed: Jun. 17, 2016

(65) Prior Publication Data

US 2017/0009995 A1 Jan. 12, 2017

(30) Foreign Application Priority Data

Jul. 7, 2015 (GB) ..... 1511841

(51) Int. Cl.
*F23R 3/00* (2006.01)
*F23R 3/28* (2006.01)
(Continued)

(52) U.S. Cl.
CPC ..... *F23R 3/286* (2013.01); *F23R 3/14* (2013.01); *F23R 3/30* (2013.01)

(58) Field of Classification Search
CPC .... F23R 3/286; F23R 3/12; F23R 3/14; F23R 3/30; F23R 3/28; F23D 11/24; F23D 11/383
See application file for complete search history.

(56) References Cited

U.S. PATENT DOCUMENTS 4,070,826 A * 1/1978 Stenger ..... F02C 7/222 239/425
4,246,757 A * 1/1981 Heberling ..... F23R 3/14 431/183

(Continued)

FOREIGN PATENT DOCUMENTS

CN 202993265 U 6/2013
EP 2772688 A2 9/2014

(Continued)

OTHER PUBLICATIONS

Dec. 5, 2016 Extended Search Report issued in European Patent Application No. 16173667.3.

(Continued)

*Primary Examiner* — Katheryn A Malatek
(74) *Attorney, Agent, or Firm* — Oliff PLC

(57) ABSTRACT

A fuel spray nozzle comprises a fuel passage (1) having at least one inlet and at least one outlet. The outlet is configured for accelerating fuel exiting the fuel passage into a jet. An air swirler (3) is arranged outboard of the fuel passage and converges to a single outlet chamber (5) adjacent the fuel passage outlet(s). The air swirler (3) can be nominally concentrically arranged but have some freedom to move axially or radially or change its angular position. The fuel passage outlets may be arranged symmetrically in an annular configuration. An air passage may be arranged axially within the annular array of fuel passage outlets.

18 Claims, 7 Drawing Sheets

(51) Int. Cl.
*F23R 3/14* (2006.01)
*F23R 3/30* (2006.01)

(56) References Cited

U.S. PATENT DOCUMENTS

| | | | | |
|---|---|---|---|---|
| 4,842,197 | A * | 6/1989 | Simon | F23C 7/002 239/400 |
| 6,363,726 | B1 | 4/2002 | Durbin et al. | |
| 2004/0035114 | A1* | 2/2004 | Hayashi | F23R 3/18 60/737 |
| 2008/0000234 | A1 | 1/2008 | Commaret et al. | |
| 2010/0050646 | A1 | 3/2010 | Lovett et al. | |
| 2010/0115956 | A1 | 5/2010 | Toon | |
| 2010/0307161 | A1* | 12/2010 | Thomson | F23D 11/107 60/748 |
| 2014/0053571 | A1* | 2/2014 | Keener | F23R 3/10 60/782 |

FOREIGN PATENT DOCUMENTS

| | | | |
|---|---|---|---|
| GB | 2198521 | A | 6/1988 |
| JP | 2004/360944 | A | 12/2004 |
| WO | 99/04196 | A1 | 1/1999 |
| WO | 2014/141830 | A1 | 9/2014 |

OTHER PUBLICATIONS

Jan. 6, 2016 Search Report issued in British Application No. 1511841.7.

* cited by examiner

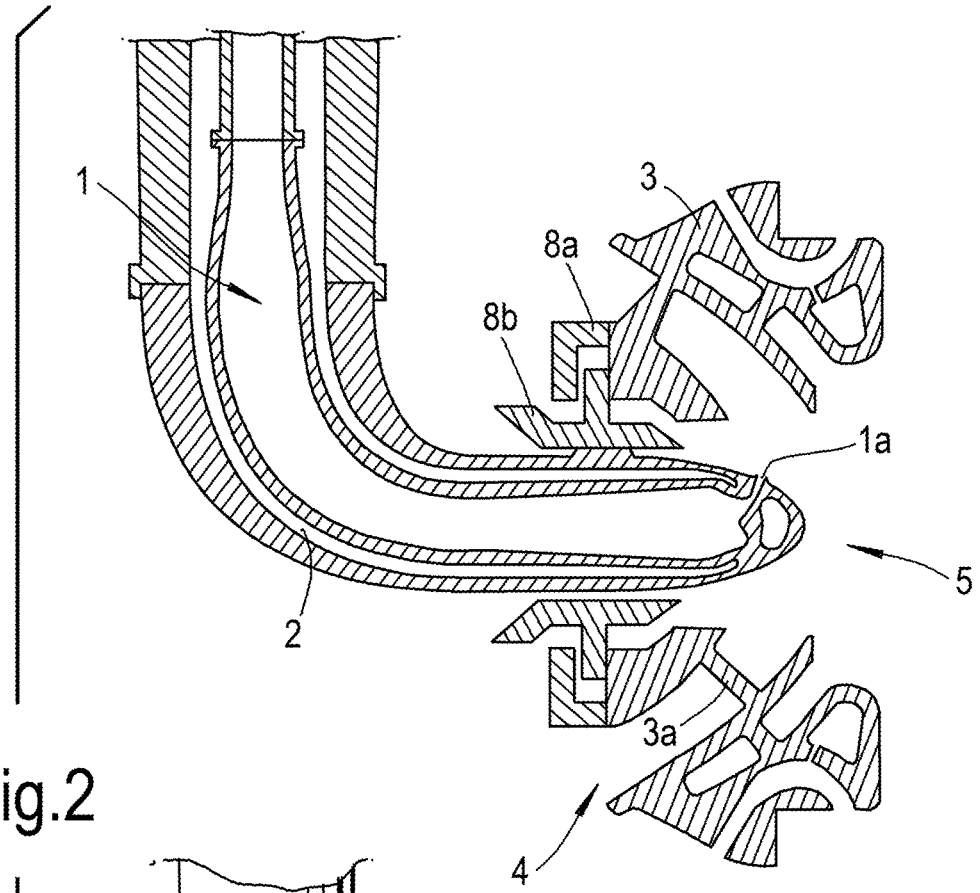
Fig.2
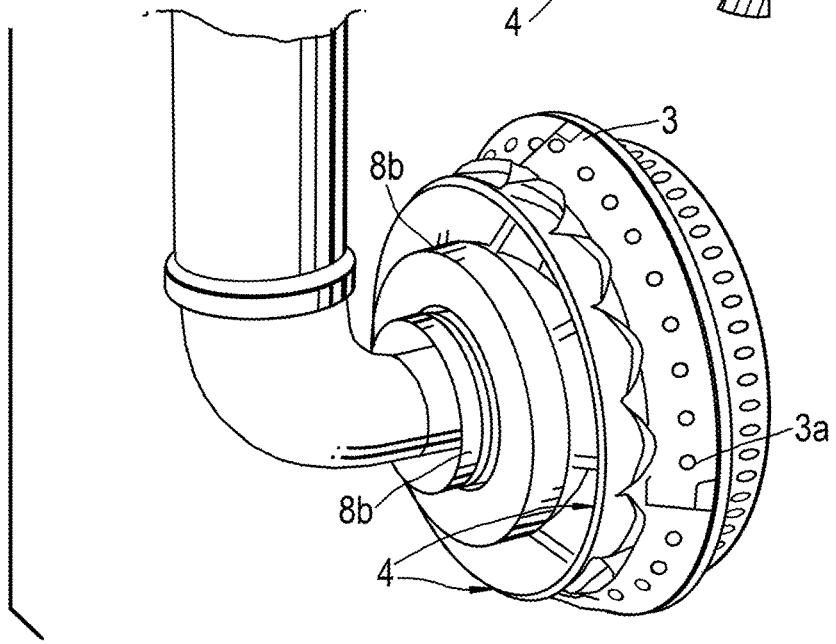

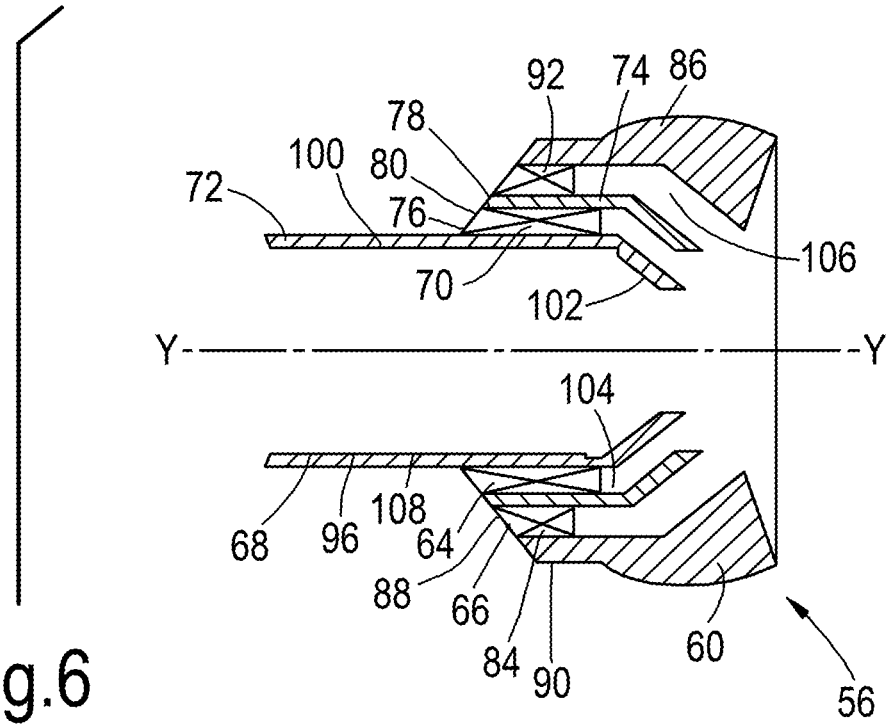
Fig.6
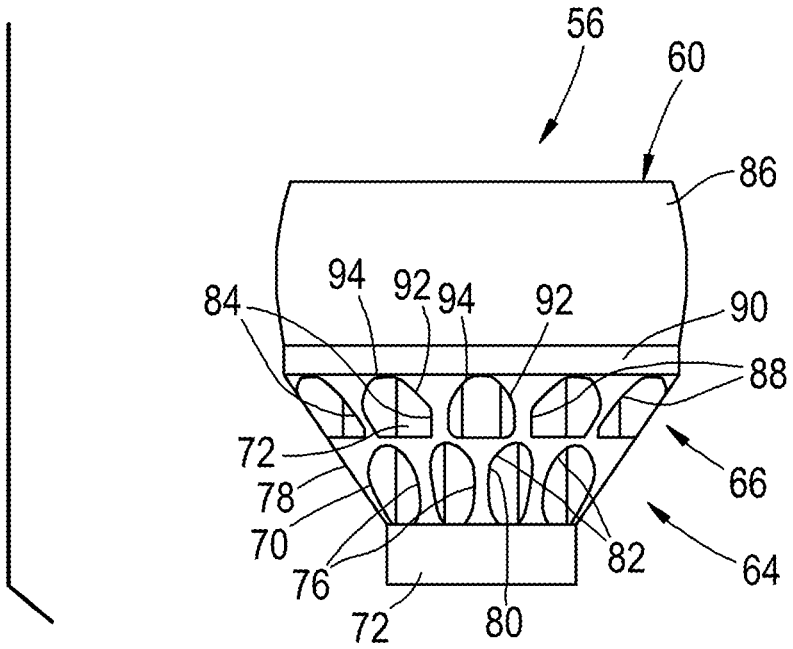

FUEL SPRAY NOZZLE FOR A GAS TURBINE ENGINE

FIELD OF DISCLOSURE

The present disclosure concerns a fuel spray nozzle for a gas turbine engine.

BACKGROUND TO THE INVENTION

In a gas turbine engine, fuel is mixed with air prior to delivery into a combustion chamber where the mixture is ignited. Arrangements for mixing the fuel and air vary. In prefilming arrangements, fuel is formed in a film along a prefilmer surface adjacent to a nozzle. Pressurised, turbulent air streams are directed against the prefilmer surface and serve to shear fuel from the surface and mix the sheared fuel into the turbulent air streams. In vaporiser designs fuel is forced through a small orifice into a more cavernous air filled chamber. The sudden pressure drop and acceleration of the fuel flow upon entering the chamber disperses the fuel into a spray. High temperatures subsequently vaporise the fuel. Turbulent air flows in the chamber again encourage mixing.

Both methods have associated advantages and disadvantages. Prefilming fuel injectors have highly complex and intricate designs that are expensive to manufacture. Design iterations are slow, due to complexity of the manufacturing process. Whilst relatively simple in design and generally cheaper in manufacture, vaporiser fuel injectors provide inferior fuel preparation when compared to prefilming fuel injectors thereby resulting in inferior engine performance.

It is desirable to provide a fuel injector which is simple in construction but has improved performance over prior art vaporiser designs.

SUMMARY OF THE INVENTION

According to a first aspect of the invention there is provided a fuel spray nozzle comprising a fuel injector and an air swirler and having the configuration as described in Claim 1. The fuel injector component comprises a fuel passage having at least one inlet and at least one outlet, the outlet is configured for accelerating fuel exiting the fuel passage and ejecting a jet of fuel. The jet is directed in crossflow across a stream of relatively high velocity air exiting a swirl passage of a radially adjacent air swirler. The air swirler is arranged outboard of the fuel injector and comprises one or more passages that terminate in a single outlet chamber in which the fuel passage outlet(s) of the fuel injector sits.

Jet in crossflow' is an airblast technique, in that the energy for atomisation is primarily provided by the airstream. It has some advantages over pre-filming injectors; the fuel is rapidly distributed over a range of radii, giving an opportunity for improved fuel/air mixing; and the mechanical design of the injector is simpler, permitting a reduction in manufacturing cost.

Desirably the fuel passage outlet and the air swirler outlet chamber are substantially axially coincident such that the jet is injected into the air stream after the air has been maximally accelerated and swirled in the swirler passages. This is assisted by walls of the swirler passages being radially convergent in a manner which directs the exiting air flow towards the fuel passage outlet to encourage mixing of the fuel and air in the outlet chamber and minimise filming of fuel on walls of the air swirler. The configuration ensures maximal atomisation of the fuel as it joins the relatively high velocity air stream.

The terms axial and radially herein are intended to refer to an axial centre-line passing through the air swirler and a radius around the axial centre-line.

Embodiments of the invention now described are configured in a jet in crossflow style of fuel spray nozzle.

In embodiments of the invention, the fuel outlet and the outlet chamber of the air swirler are positioned with respect to each other to maximise vaporisation of the fuel as it meets the air. The velocity and swirl imparted to the air in the swirler passages further assists in efficient mixing of the fuel and air on route to the combustion chamber. Optimal results can be achieved in part by optimising the angle of injection of the jet of fuel with respect to the direction at which the air exits a swirler passage and/or by the relative axial position of the fuel passage outlet relative to a terminus of the one or more swirler passages.

It will be appreciated that walls of the air swirler passages influence the predominant flow direction of an air stream exiting the swirler passages. The fuel passage outlet and walls of the swirler passages are directed towards each other so as to create a collision of the fuel and air streams which is within an optimum angle range (the vertex of the angle being downstream from the fuel outlet). The optimum angle is such that the fuel penetrates as far as possible across the radially adjacent swirl passage, without excessive impingement on the prefilming surface or any impingment on the outer wall of radially distal swirl passages.

For example, the optimum angle range is 30 to 150 degrees. More preferably, the range is 60 to 150 degrees, for example between about 90 and 130 degrees. The optimum arrangement may be influenced by factors such as the flow rate of the air and fuel at their outlets. The optimum angle range ensures that the mix of fuel with air in the air swirler outlet chamber is maximised and the amount of fuel crossing to a wall of the air swirler minimised.

Any fuel not picked up in the cross flow may collect on a prefilming surface which forms part of the air swirler or fuel injector. For example, the prefilmer surface is in the form of a cone of the fuel passage which extends and converges in a direction downstream from the fuel outlet. Alternatively the prefilmer may be a radially inwardly facing surface of the air swirler.

The fuel passage may have an annular configuration. The fuel passage may comprise a plurality of outlets symmetrically arranged around an annulus. Additional fuel circuits may be arranged inboard of the air swirler within the fuel injector to permit staging of the engine. Optionally the additional fuel circuits are annularly arranged.

The air swirler may be nominally concentrically arranged with respect to the fuel passage.

Optionally, a separate seal component is arranged between the air swirler and the fuel passage and is configured to allow radial and/or angular and/or axial movement between the air swirler and fuel passage. The seal may be configured to allow controlled leakage flow (for example specific metered flow) to pass through the passage between the fuel passage and air swirler.

In some embodiments, the fuel spray nozzle further comprises a non-swirling air jet. The air jet supply passage can pass axially through an annularly arranged fuel passage. In other embodiments the air passage may be annular and arranged outboard of the fuel passage. The air jet is advantageous in preventing a recirculating vortex from penetrating into the fuel spray nozzle thereby reducing carbon deposition on, and aerodynamic blocking of, the nozzle exit.

In some embodiments the fuel passage is protected from the ambient air by means of one or more cavities filled with stagnant air that acts as an insulating layer. These cavities can be configured to protect the fuel from heat flowing from the air in the air swirler, between the air swirler and fuel injector, or from any other air passage built into the fuel injector.

Upstream of the single outlet, the air swirler may comprise one or more air passages (which may optionally be convergent), extending annularly which include vanes configured to impart swirl on transmitted air. These passages may be configured to drive an axial flow or a radial flow, or a flow in any combination of these directions. Multiple convergent air passages may be aligned to have axial overlap, the outer radial wall of a first convergent passage forming a radially inner wall of an adjacent, upstream convergent passage. The vanes can be arranged to extend between the radially outer and radially inner walls of the converging passage, being exposed beyond the downstream edge of the most upstream radially outer wall.

At the upstream edge, the walls of the convergent air passages can be arched or undulated such that the length from the outlet chamber to the upstream edge is variable around the radial outer wall. The arches can be uniform. Where two or more convergent passages are provided with undulations, the radially outer walls of the passage may be arranged at different angular rotations relative to each other. The leading edges of the vanes connecting adjacent annular structures can be arched or inclined. Such a configuration is well suited to manufacture using additive layer manufacturing (ALM) techniques, for example direct laser deposition (DLD). The ability to use such manufacturing techniques provides greater flexibility in design of vane and passage shapes, allowing these shapes to be optimised to enhance aerothermal performance. By optimising vane and passage configurations to provide high intensity air turbulence and speed, the efficient atomisation of fuel into a fine spray with substantially uniform droplet size distribution can be achieved. The air swirler outlet and convergent air passages can be provided with a throat profile which is configured to control the cone angle of the exiting air. Achievable results can be comparable to or even exceed the atomisation provided by complex prefilmer arrangements.

EP2772688 discloses one embodiment of an air swirler suitable for use in embodiments of the fuel spray nozzle of the invention.

It will be appreciated that as well as shape, the number of vanes and passages can also be varied to suit requirements without departing from the scope of the claimed invention.

The described arrangement is relatively insensitive in terms of effective area with respect to axial, radial and angular movement between the fuel injector (which comprises the fuel passage and outlet) and the air swirler. Thus the fuel injector and air swirler can be mounted independently.

The separation of the fuel injector from the air swirler reduces the complexity and the cost of the manufacturing process compared to prior art prefilmer design.

The position of the fuel injector within the air swirler means that the air swirler can be combustor-mounted, reducing stress within both the combustion module casing and the fuel injector and thereby reduces the requisite size, aerodynamic drag, cost and weight of the fuel spray nozzle and combustion module casing compared to prior art arrangements.

The nozzle may further incorporate a thermal management system. A thermal management system might comprise a cooling circuit and/or a heat shield. In some embodiments an integral heat shield may extend radially outwardly from the outlet to provide an axially upstream facing heat shield surface.

BRIEF DESCRIPTION OF THE DRAWINGS

Embodiments of the invention will now be described by way of example only, with reference to the Figures, in which:

FIG. 2 is a section of a fuel spray nozzle in accordance with a first embodiment of the invention, showing the air swirler, fuel injector and (optional) seal components;

FIG. 6 shows an example of an air swirler configuration suitable for use in fuel spray nozzles in accordance with the invention;

DETAILED DESCRIPTION OF SOME EMBODIMENTS OF THE INVENTION

Figure 1:
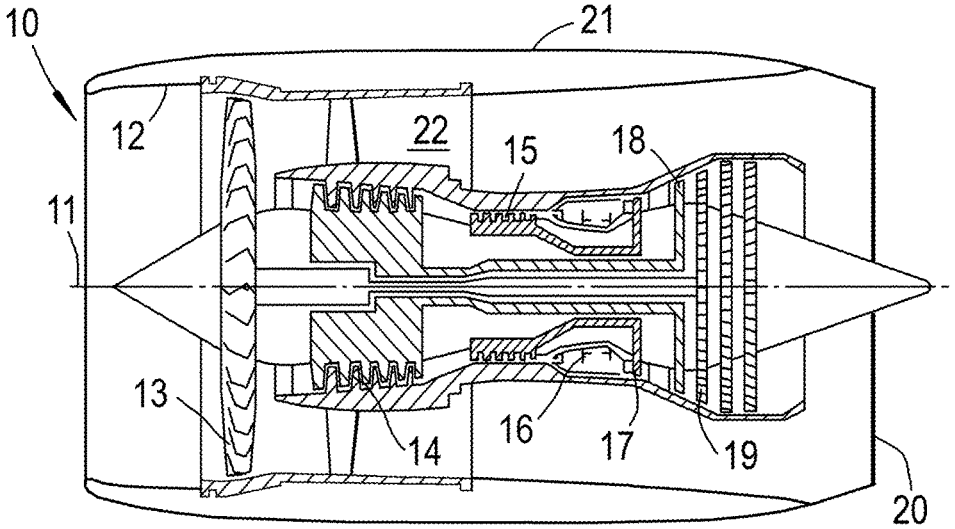
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

In FIGS. 2 to 5, embodiments of the invention have an axis passing centrally through the fuel passage with the air swirler arranged radially outboard of the axis.

In FIG. 2, a fuel passage 1 extends to form an annular fuel channel having fuel outlet ports 1*a*. Air swirler 3 is coaxially aligned and radially outboard of the annular fuel channel wherein swirl passages 4 converge to a common outlet chamber 5. It is to be noted that the outlet ports 1*a* are directed at an angle which is between the co-axial centre-line and a radius of the air swirler 3. Furthermore, the outlet is arranged to substantially coincide with outlet chamber 5 of the air swirler 3. Thus, a jet of fuel exiting the fuel injector by outlet 1*a* is directed in cross-flow with air exiting an air swirler passage 4 and entering outlet chamber 5. An annular cavity 2 (for example containing stagnant air or another insulator) surrounds the fuel passage 1 and serves as a heat shield. Optional seal components 8*a* and 8*b* sit between the annular fuel channel and swirler 3. The seal components 8*a*, 8*b* ensure air is predominantly directed through the air swirler 3 and inside the radially outer annular chamber. As can be seen, male and female parts of the seal components 8*a*, 8*b* engage in a radial direction, however, they are not locked in position, radial space between walls of the male and female parts allow radial movement of the swirler 3 relative to the fuel injector 1. Axial and angular movement is allowed for by sliding or rotation of the fuel injector inside the air swirler. For this purpose, a spherical section is included on the body of the fuel injector, which is free to slide inside the interfacing cylindrical section of the air swirler.

The swirler comprises annular channels 4 crossed by swirl vanes 3*a*. The channels 4 converge to a common outlet chamber 5.

Figure 3:
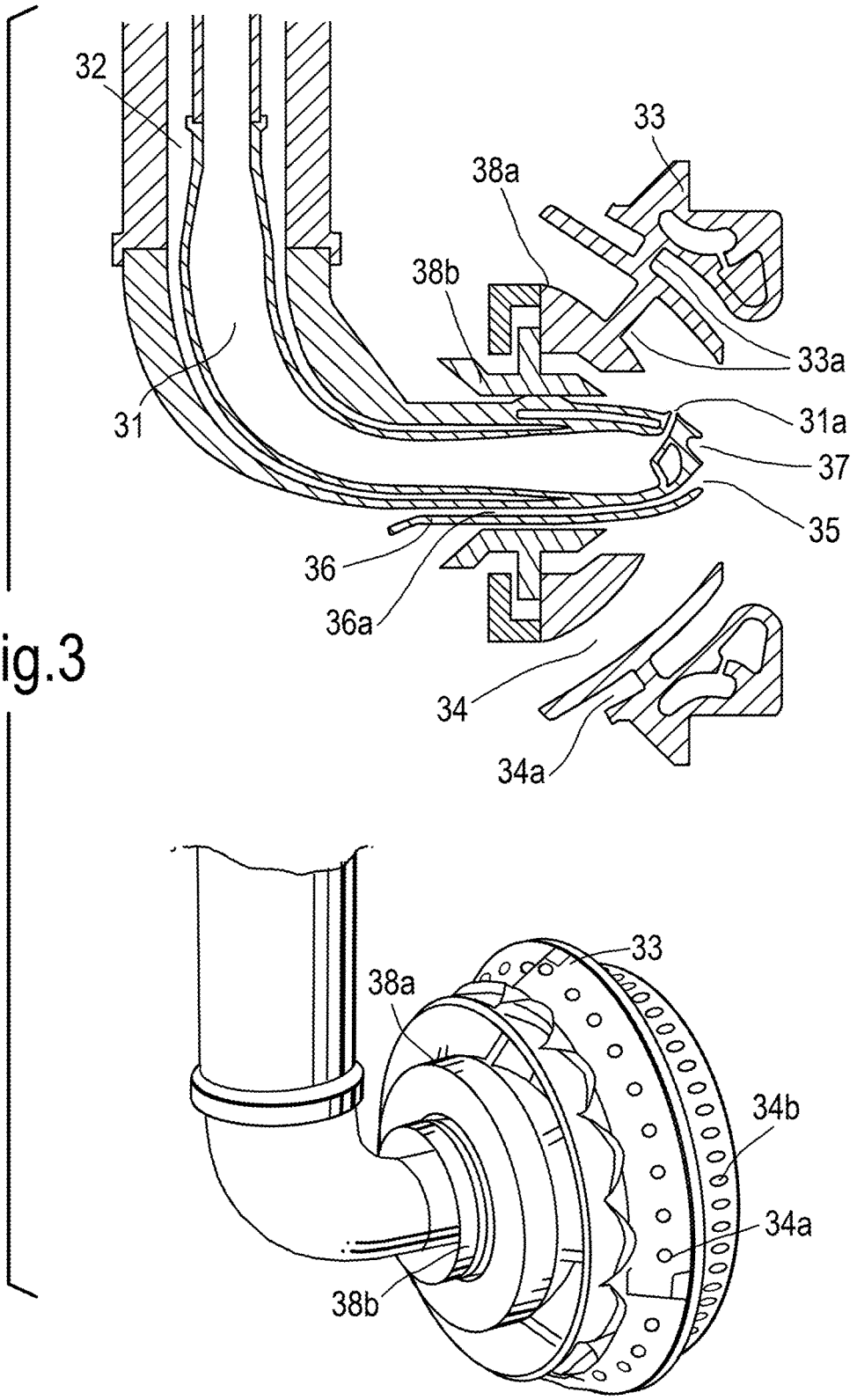
FIG. 3 is a section of a fuel spray nozzle in accordance with a second embodiment of the invention, showing the air swirler, fuel injector and (optional) seal components.

Referring now to FIG. 3, a fuel spray nozzle comprises a centrally arranged fuel injector passage 31 having an outlet 31*a*. An annular space 32 is radially adjacent the fuel injector passage 31 and serves as a heat shield. Arranged coaxially with the fuel injector passage 31 at the outlet 1*a* end, is an air swirler 33 comprising coaxially arranged swirler passages 34 converging towards a common outlet chamber 35 which sits adjacent the fuel passage outlet 31*a*. It is to be noted that the outlet ports 31*a* are directed at an angle which is between the co-axial centre-line and a radius of the air swirler 33. Furthermore, the outlet is arranged to substantially coincide with outlet chamber 35 of the air swirler 33. Thus, a jet of fuel exiting the fuel injector by outlet 31*a* is directed in cross-flow with air exiting an air swirler passage 34 and entering outlet chamber 35. An annular wall 36 between the air swirler 33 and the fuel passage 31 channels non swirling air towards a centrally arranged air jet outlet 37. Optional seal components 38*a*, 38*b* ensure air is predominantly directed through the air swirler 33 and inside the chamber 36*a* defined by the annular wall 6 towards the air jet outlet 37. An optional integrated cooling system is associated with the nozzle and has cooling air inlets 34*a* and outlets 34*b*.

Air swirler 33 comprises coaxially aligned air passages 34 having inlets 34*a* which converge towards a common outlet chamber 35. Swirler vanes 33*a*, 33*b* extend between walls of coaxially adjacent passages 34.

Figure 4:
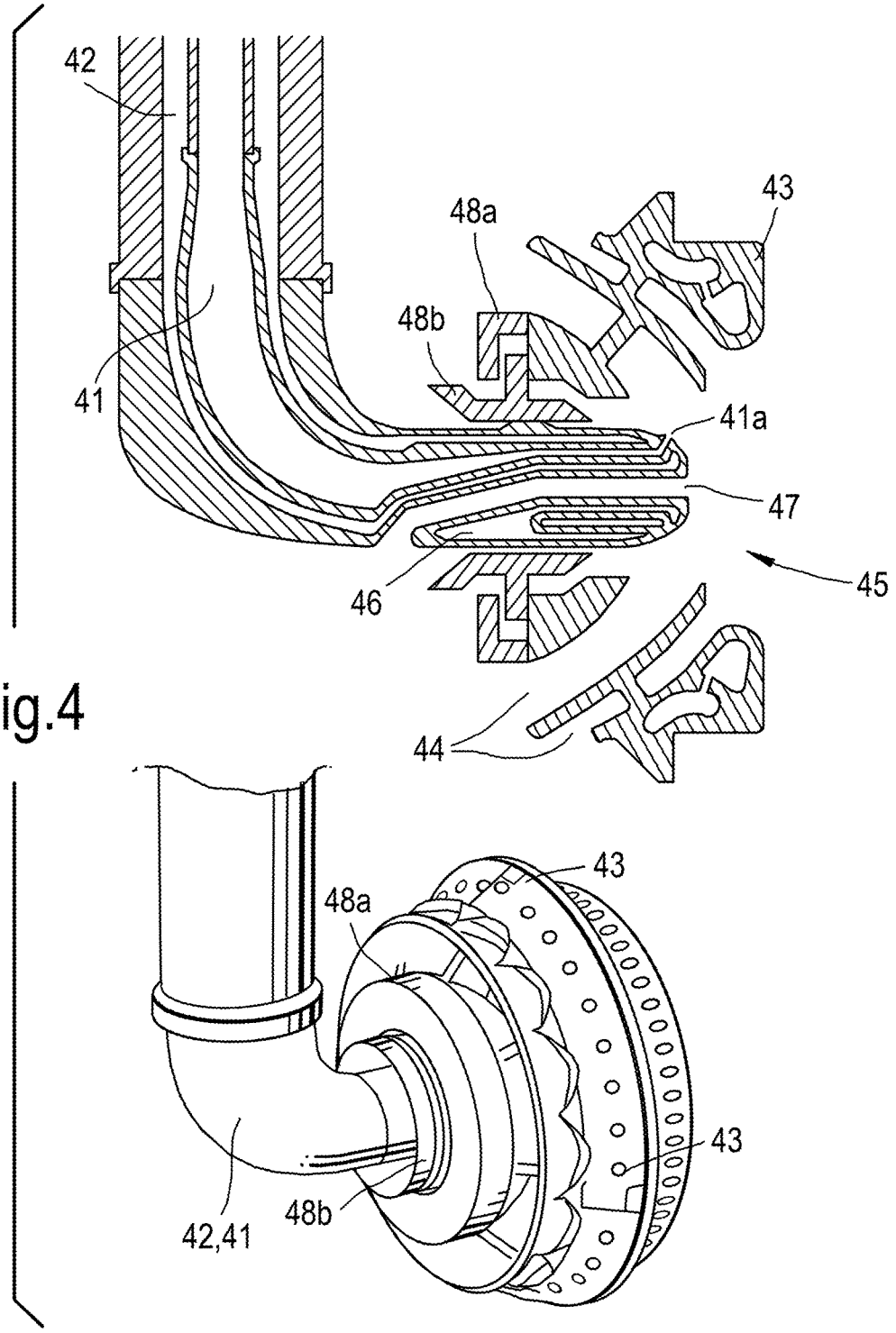
FIG. 4 is a section of a fuel spray nozzle in accordance with a third embodiment of the invention, showing the air swirler, fuel injector and (optional) seal components.

In FIG. 4, a fuel passage 41 extends to form an annular fuel channel having fuel outlet ports 41*a*. A non-swirling air passage 46*a* passes through the centre of the annular fuel channel and has an outlet 47. It is to be noted that the outlet ports 41*a* are directed at an angle which is between the co-axial centre-line and a radius of the air swirler 43. Furthermore, the outlet is arranged to substantially coincide with outlet chamber 45 of the air swirler 43. Thus, a jet of fuel exiting the fuel injector by outlet 41*a* is directed in cross-flow with air exiting an air swirler passage 44 and entering outlet chamber 45. Air swirler 43 is coaxially aligned and radially outboard of the annular fuel channel wherein swirl passages 44 converge to a common outlet chamber 45. An annular heat shield surrounds the fuel passage 41. Optional seal components 48*a* and 48*b* sit between the annular fuel channel and swirler 4 downstream of the entrance to non-swirling air channel 46*a*. An annular void space 42 is radially adjacent the fuel injector passage 41 and serves as a heat shield.

Figure 5:
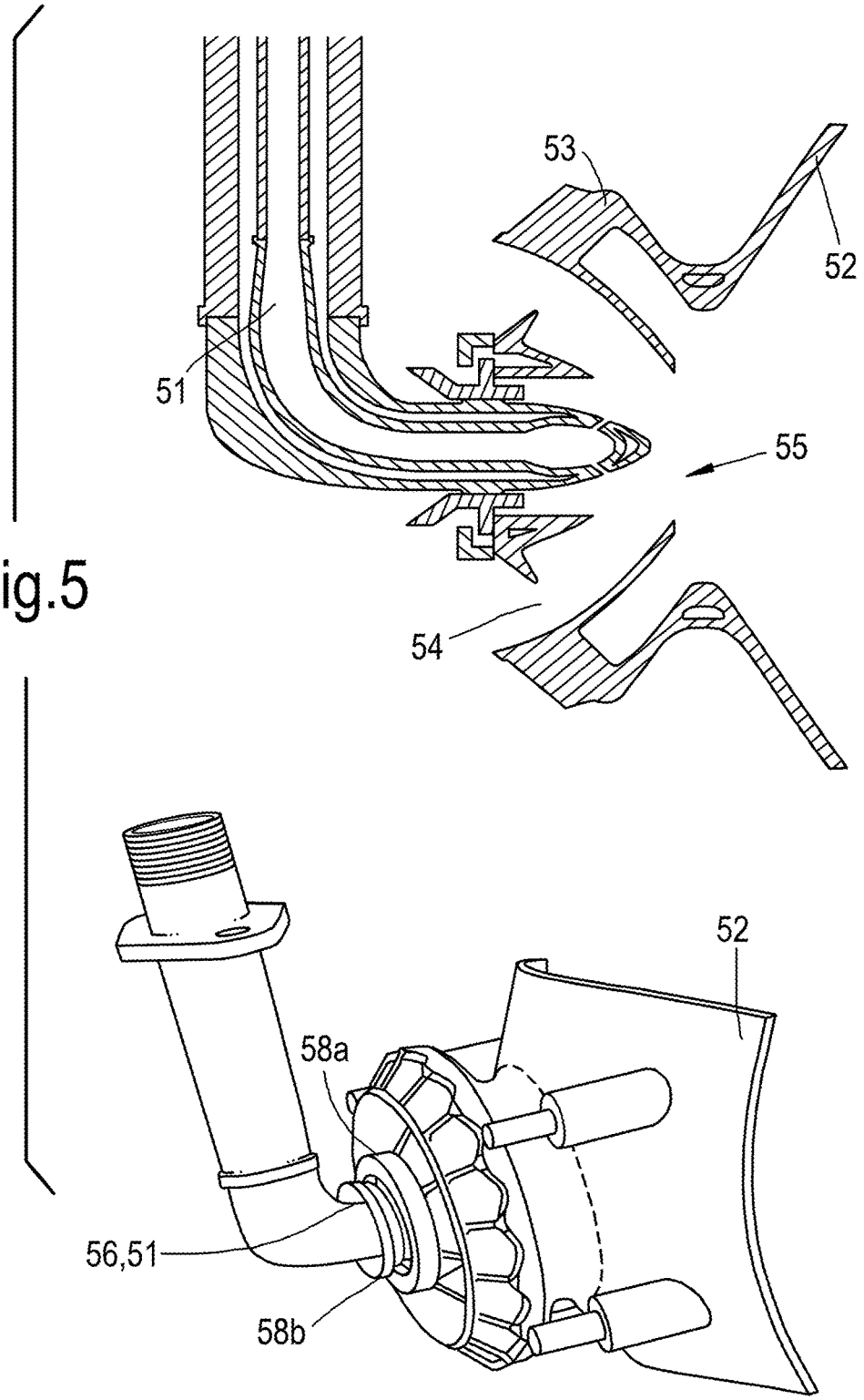
FIG. 5 is a section of a fuel spray nozzle in accordance with a fourth embodiment of the invention, showing the air swirler, fuel injector and (optional) seal components and combustor heat shield.

In FIG. 5, an annular fuel passage 51 sits centrally of the nozzle. An air swirler 53 is arranged coaxially with the annular fuel passage 51 and converges to a chamber 55 immediately downstream of the passage 51 outlet 51*a*. It is to be noted that the outlet ports 51*a* are directed at an angle which is between the co-axial centre-line and a radius of the air swirler 53. Furthermore, the outlet is arranged to substantially coincide with outlet chamber 55 of the air swirler 53. Thus, a jet of fuel exiting the fuel injector by outlet 51*a* is directed in cross-flow with air exiting an air swirler passage 54 and entering outlet chamber 55. A downstream facing combustor heat shield 52 extends from a downstream end of the swirler in a radially divergent manner. The heat shield 52 could be inclined or perpendicular to the central axis of the fuel injector, and could be of any shape. This heat shield could be cooled (for example but without limitation) by impingement of air on the cold side, effusion of air from the hot side or a combination of these.

FIG. 6 shows an air swirler suitable for use in a nozzle in accordance with the invention. The swirler has an axis Y and comprises a first swirler 64, a second swirler 66 and an additional swirler 68. The first swirler 64 comprises a plurality of vanes 70, a first member 72 and a second member 74. The second member 74 is arranged coaxially around the first member 72 and the vanes 70 extend radially between the first and second members 72 and 74. The vanes 70 have leading edges 76 and the second member 74 has an upstream end 78. The leading edges 76 of the vanes 70 extend with radial and axial components from the first member 72 to the upstream end 78 of the second member 74 and the radially outer ends 80 of the leading edges 76 of the vanes 70 form arches 82 with the upstream end 78 of the second member 74. In particular the leading edges 76 of the vanes 70 extend with axial downstream components from the first member 72 to the upstream end 78 of the second member 74.

The second swirler 66 comprises a plurality of vanes 84 and a third member 86. The third member 86 is arranged coaxially around the second member 74. The vanes 84 of the second swirler 66 extend radially between the second and third members 74 and 86. The vanes 84 of the second swirler 66 have leading edges 88 and the third member 86 has an upstream end 90. The leading edges 88 of the vanes 84 of the second swirler 66 extend with radial and axial components from the upstream end 78 of the second member 74 to the upstream end 90 of the third member 86 and the radially outer ends 92 of the leading edges 88 of the vanes 84 of the second swirler 66 form arches 94 with the upstream end 90 of the third member 86. In particular the leading edges 88 of the vanes 84 extend with axial downstream components from the upstream end 78 of the second member 74 to the upstream end 90 of the third member 86.

The first member 72, the second member 74 and the third member 86 are generally annular members with a common axis Y. Thus, the upstream end of the first member 72 is upstream of the upstream end 78 of the second member 74 and the upstream end 78 of the second member 74 is upstream of the upstream end 90 of the third member 86.

The outer surface of the downstream end of the first member 72 tapers/converges towards the axis Y of the fuel injector head 60. The first member 72 The downstream end of the second member 74 tapers/converges towards the axis Y of the fuel injector head 60 and the inner surface of the downstream end of the third member 86 initially tapers/converges towards the axis Y of the fuel injector head 60 and then diverges away from the axis Y of the fuel injector head 60. An annular passage 104 is defined between the first member 72 and the second member 74 and an annular passage 106 is defined between the second member 74 and the third member 86. A central passage 108 is defined within the first member 74 in which a fuel passage can be received in accordance with the invention.

It is seen that the fuel injector head 60 is arranged such that the leading edges 76 and 88 of the vanes 70 and 84 respectively are arranged to extend with axial downstream components from the first member 72 to the upstream end 78 of the second member 74 and from the second member 74 to the upstream end 90 of the third member 86 respectively. In addition it is seen that the fuel injector head 60 is arranged such that the radially outer ends 80 and 92 of the leading edges 76 and 88 of the vanes 70 and 84 respectively form arches 82 and 94 with the upstream ends 78 and 90 of the second and third member 74 and 86 respectively. These features enable the fuel injector head 60 and in particular the first and second swirlers 64 and 66 of the fuel injector head 60 to be manufactured by direct laser deposition. These features enable the vanes 70 of the first swirler 64 to provide support between the first member 72 and the second member 74 and the vanes 84 of the second swirler 66 to provide support between the second member 74 and the third member 86 during the direct laser deposition process.

Figure 7:
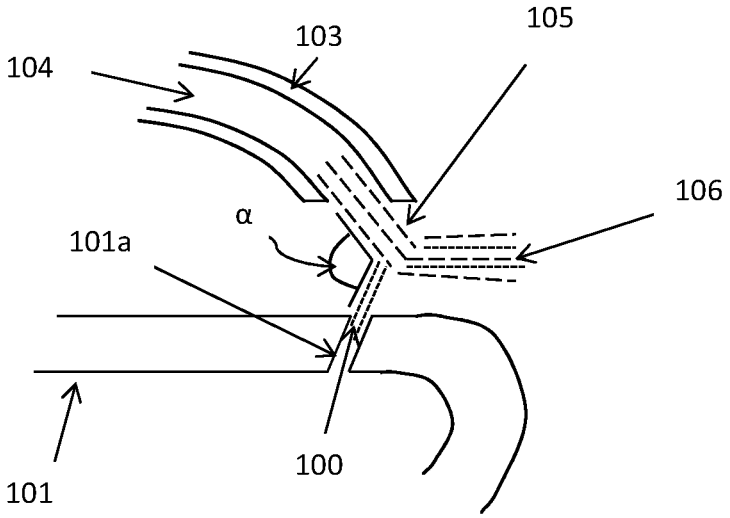
FIG. 7 shows the interaction of air flowing from a swirler passage and fuel flowing from a fuel injector in an embodiment of a fuel spray nozzle in accordance with the invention.

FIG. 7 shows in closer detail a fuel passage 101 having a fuel passage outlet 101*a* which is shaped and proportioned to generate a substantially parallel sided jet of fuel 100. A swirler passage 104 of an air swirler 103 sits radially outboard of the fuel passage 101 and has radially converging walls which direct an air flow having a predominant flow 105 to meet the jet 100 in cross flow at an angle $\alpha$. The angle $\alpha$ is within an optimum range as discussed above. The two streams 101 and 105 mix thoroughly and the mixture 106 is carried downstream to a combustion chamber.

The skilled person will appreciate that except where mutually exclusive, a feature described in relation to any one of the above aspects of the invention may be applied mutatis mutandis to any other aspect of the invention.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A fuel spray nozzle comprising:

a fuel injector: and an annular air swirler, wherein the fuel injector comprises a fuel passage arranged centrally of the annular air swirler and having at least one fuel inlet and at least one fuel outlet, the at least one fuel outlet configured for accelerating fuel exiting the fuel passage into a jet of fuel, and the annular air swirler comprises one or more swirl passages, the one or more swirl passages comprising at least one radially outer wall with an end of the at least one radially outer wall converging towards an axis of the annular swirler and the one or more swirl passages converging towards the axis to a single outlet, the at least one fuel outlet directed towards the radially outer wall at a position upstream of said end of said wall so that a center line of the fuel passage at the at least one fuel outlet forms a non-zero angle with a center line of the fuel injector at the at least one fuel outlet, wherein, in use, the jet of fuel is directed across a stream of air exiting the one or more swirl passages at the single outlet.

2. The fuel spray nozzle as claimed in claim 1, wherein the annular air swirler is nominally concentrically arranged with respect to the fuel passage.

3. The fuel spray nozzle as claimed in claim 1, wherein the at least one fuel outlet and walls of the one or more swirl passages, including the at least one wall, are directed towards each other so as to create a collision of the fuel and air streams which is within an angle range, the vertex of the angle being downstream from the at least one fuel outlet, the angle range selected such that, in use, the fuel penetrates as far as possible across a radially adjacent swirl passage, without impingement on an outer wall of the walls of a swirl passage of the one or more swirl passages, the swirl passage being radially distal to a fuel outlet of the at least one fuel outlet.

4. The fuel spray nozzle as claimed in claim 3, wherein the angle range is 30 to 150 degrees.

5. The fuel spray nozzle as claimed in claim 4, wherein the angle range is 60 to 150 degrees.

6. The fuel spray nozzle as claimed in claim 5, wherein the angle range is 90 to 130 degrees.

7. The fuel spray nozzle as claimed in claim 1, further comprising a seal component arranged between the air swirler and the fuel passage and wherein the seal component is configured to allow radial and/or axial and/or angular movement between the air swirler and the fuel passage.

8. The fuel spray nozzle as claimed in claim 7, wherein the seal component is configured to permit a metered flow between the air swirler and the fuel injector.

9. The fuel spray nozzle as claimed in claim 1 comprising a plurality of fuel passage outlets, including the at least one fuel outlet, symmetrically arranged in an annular configuration.

10. The fuel spray nozzle as claimed in claim 1, wherein upstream of the single outlet, the air swirler comprises the one or more swirl passages coaxially arranged and extending annularly, the one or more swirl passages including vanes configured to impart swirl on the stream of air.

11. The fuel spray nozzle as claimed in claim 1, wherein the fuel passage is annular and further comprising an air jet co-axially arranged in an air passage passing axially through the annular fuel passage.

12. The fuel spray nozzle as claimed in claim 1, wherein the air swirler outlet and/or the at least one fuel outlet have a profiled throat configured to control a cone angle of the stream of air.

13. The fuel spray nozzle as claimed in claim 1, further including an annular void space around the fuel passage which serves as a heat shield for the fuel passage.

14. The fuel spray nozzle as claimed in claim 1, including an axially downstream and radially outwardly extending heat shield formed integrally with the annular air swirler.

15. A gas turbine engine incorporating a fuel spray nozzle, the fuel spray nozzle having the configuration as set forth in claim 1.

16. The fuel spray nozzle as claimed in claim 1, wherein the end of each wall converging towards the axis of the annular air swirler at least partially define the single outlet where the at least one fuel outlet sits.

17. A fuel spray nozzle comprising:

a fuel injector; and an annular air swirler, wherein the fuel injector comprises a fuel passage arranged centrally of the annular air swirler and having at least one fuel inlet and at least one fuel outlet, the at least one fuel outlet configured for accelerating fuel exiting the fuel passage into a jet of fuel, and the annular air swirler comprises one or more swirl passages, the one or more swirl passages comprising at least one radially outer wall with an end of the at least one radially outer wall converging towards an axis of the annular swirler and the one or more swirl passages converging towards the axis to a single outlet, the at least one fuel outlet directed towards the radially outer wall at a position upstream of said end of said wall, wherein, in use, the jet of fuel is directed across a stream of air exiting the one or more swirl passages at the single outlet; and a seal component arranged between the air swirler and the fuel passage and wherein the seal component is configured to allow radial and/or axial and/or angular movement between the air swirler and the fuel passage.

18. A fuel spray nozzle comprising:

a fuel injector; and an annular air swirler, wherein the fuel injector comprises a fuel passage arranged centrally of the annular air swirler and having at least one fuel inlet and at least one fuel outlet, the at least one fuel outlet configured for accelerating fuel exiting the fuel passage into a jet of fuel, the annular air swirler comprises one or more swirl passages, the one or more swirl passages comprising at least one radially outer wall with an end of the at least one radially outer wall converging towards an axis of the annular swirler and the one or more swirl passages converging towards the axis to a single outlet, the at least one fuel outlet directed towards the radially outer wall at a position upstream of said end of said wall, wherein, in use, the jet of fuel is directed across a stream of air exiting the one or more swirl passages at the single outlet, and the fuel passage is annular and further comprising an air jet co-axially arranged in an air passage passing axially through the annular fuel passage.

* * * * *